US008096369B2

(12) United States Patent
Meixner

(10) Patent No.: US 8,096,369 B2
(45) Date of Patent: Jan. 17, 2012

(54) STRIKING MECHANISM FOR A HANDHELD ELECTRIC POWER TOOL

(75) Inventor: Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 210 days.

(21) Appl. No.: 12/521,455

(22) PCT Filed: Oct. 29, 2007

(86) PCT No.: PCT/EP2007/061597

§ 371 (c)(1),
(2), (4) Date: Jun. 26, 2009

(87) PCT Pub. No.: WO2008/080653

PCT Pub. Date: Jul. 10, 2008

(65) Prior Publication Data

US 2010/0326689 A1 Dec. 30, 2010

(30) Foreign Application Priority Data

Dec. 27, 2006 (DE) ..... 10 2006 061 627

(51) Int. Cl.
*B25D 17/06* (2006.01)

(52) U.S. Cl. ..... 173/122; 173/90; 173/103

(58) Field of Classification Search ..... 173/122, 173/90, 217, 103
See application file for complete search history.

(56) References Cited

U.S. PATENT DOCUMENTS

| | | | | |
|---|---|---|---|---|
| 3,828,863 | A * | 8/1974 | Bleicher et al. | 173/48 |
| 4,353,425 | A * | 10/1982 | Simpson | 173/109 |
| 4,366,869 | A * | 1/1983 | Bereiter et al. | 173/109 |
| 4,442,906 | A * | 4/1984 | Simpson | 173/48 |
| 4,476,941 | A * | 10/1984 | Buck et al. | 173/117 |
| 4,497,380 | A * | 2/1985 | Flack et al. | 173/117 |
| 4,712,625 | A * | 12/1987 | Kress | 173/104 |
| 5,117,923 | A * | 6/1992 | Wuhrer | 173/109 |
| 5,373,905 | A * | 12/1994 | Bleicher et al. | 173/109 |
| 5,806,609 | A * | 9/1998 | Stock et al. | 173/205 |
| 5,816,341 | A * | 10/1998 | Bone et al. | 173/48 |
| 6,116,352 | A * | 9/2000 | Frauhammer et al. | 173/212 |
| 6,491,020 | B2 | 12/2002 | Kotchi et al. | |
| 6,550,546 | B2 * | 4/2003 | Thurler et al. | 173/48 |
| 7,028,786 | B2 * | 4/2006 | Kuhnle et al. | 173/131 |
| 7,121,359 | B2 * | 10/2006 | Frauhammer et al. | 173/48 |
| 7,753,135 | B2 * | 7/2010 | Lennartz | 173/109 |
| 2002/0050365 | A1 * | 5/2002 | Bongers-Ambrosius et al. | 173/128 |
| 2003/0070823 | A1 * | 4/2003 | Kristen et al. | 173/217 |
| 2010/0012337 | A1 * | 1/2010 | Meixner | 173/114 |
| 2010/0025061 | A1 * | 2/2010 | Meixner et al. | 173/118 |

* cited by examiner

*Primary Examiner* — Brian D Nash
(74) *Attorney, Agent, or Firm* — Ronald E. Greigg

(57) ABSTRACT

The invention relates to a striking mechanism of a handheld electric power tool, in particular a percussion drill and/or percussion hammer, having a hammer cylinder, a piston mounted with a guide section inside the hammer cylinder in a longitudinally displaceable manner, and a piston outer guide on which a guide area of the piston is guided in a longitudinally displaceable manner. A piston end located outside the hammer cylinder comprises an overlap for overlapping an end area of the hammer cylinder, and the guide area at least partially belongs to the overlap or is affixed there.

20 Claims, 2 Drawing Sheets

STRIKING MECHANISM FOR A HANDHELD ELECTRIC POWER TOOL

CROSS-REFERENCE TO RELATED APPLICATION

This application is a 35 USC 371 application of PCT/EP2007/061597 filed on Oct. 29, 2007.

BACKGROUND OF THE INVENTION

Field of the Invention

The invention relates to a striking mechanism of an electric handheld power tool, in particular a rotary and/or percussion hammer.

Description of the Prior Art

An impact mechanism with a hammer tube, a piston, and an external piston guide is known, for example, for percussion hammers. The impact mechanism drives a tool, for example a chisel, abruptly forward in a periodically repeating fashion. In order to produce a corresponding impulse, the piston that an electric motor moves in reciprocating fashion moves—at least partially—in the hammer tube and drives a striking element, which is likewise guided by the hammer tube, via an air cushion situated between the piston and the striking element. The moving striking mass of the striking element transmits an impulse when it strikes against a tool element. The tool element in this case can be the tool itself, part of a tool holder, or an impact pin situated between the tool and the striking element. The preferably cylindrical piston is supported in a longitudinally movable fashion in the hammer tube by means of a guide section and is driven by the drive unit of the impact mechanism, for example by means of a connecting rod. Since the guide region of the piston is situated outside the hammer tube in every position of the reciprocating motion, the impact mechanism has an external piston guide likewise situated outside the hammer tube. Consequently, on the one hand, the piston is guided in a longitudinally movable fashion in the hammer tube by means of a guide section and on the other hand, is guided in a longitudinally movable fashion by means of an external piston guide that is situated, viewed from the tool, behind the hammer tube in the longitudinal direction of the hammer tube. The usual overall length of an impact mechanism with a cylindrical piston is composed of the overall length of the impact mechanism, the air cushion, the piston, and the associated connecting rod or other piston drive element. This overall length cannot be easily reduced without influencing the function of the impact mechanism.

SUMMARY AND ADVANTAGES OF THE INVENTION

According to one proposal, in the impact mechanism according to the invention, a piston end situated outside the hammer tube has an overlap end for overlapping an end region of the hammer tube; in addition, the guide region is at least partly a component of the overlap end or is fastened to it. In this case, the guide region is at least partially situated on the outer circumference of the overlap end. Because the piston end protruding from the hammer tube has an overlap end for overlapping an end region of the hammer tube and the guide region is at least partly a component of the overlap end or is fastened to it, the external piston guide can be—at least partially—situated in a longitudinal section of the impact mechanism that coincides with the hammer tube. In the longitudinal direction, this yields an "overlap region" of the external piston guide with the hammer tube. This "shifting" of the external piston guide in the direction toward the hammer tube makes it possible to reduce the overall length of the impact mechanism and therefore of the electric handheld power tool as a whole without limiting the length of the external piston guide. It is consequently possible to produce the shortest possible impact mechanism while at the same time maintaining the largest possible guide surface between the external piston guide and the guide region. In particular, the impact mechanism here includes the piston drive unit. This piston drive unit is preferably part of an overall drive unit that drives the tool in all of the movements that the electric handheld power tool allows.

According to another proposal, a piston drive element that belongs to a piston drive unit is at least partially a component of the overlap end or is fastened to it. For example, the piston drive element is a connecting rod that is fastened to the overlap end, for example by means of a cotter pin, and is used by the piston drive unit to drive the piston in an oscillating, reciprocating fashion. Because of the embodiment of the piston drive element at the overlap end, the piston drive unit engages the overlap end of the piston laterally, thus advantageously achieving a particularly short overall length of the impact mechanism.

According to one advantageous proposal, the piston drive unit has an eccentric mechanism that cooperates with the piston drive element to produce the movement of the piston. In particular, the eccentric mechanism is equipped with a crank. The cooperation of the crank with the piston drive element converts a rotary motion of the piston drive unit into the oscillating reciprocation of the piston.

According to another advantageous proposal, the piston drive element is embodied in the form of a sliding block guide. The sliding block guide is advantageously composed of two opposing ribs between which a groove is embodied. The ribs here are preferably of one piece with the overlap end. The sliding block guide is advantageously situated essentially perpendicular to the movement direction of the piston.

According to another proposal, the eccentric mechanism has an eccentric protrusion that engages in the sliding block guide. The engagement of the eccentric protrusion in the sliding block guide converts the initial rotary motion of the piston drive unit into the oscillating reciprocation of the piston.

According to a proposal in a modification of the invention, the overlap end with the piston end constitutes an overlap sleeve or at least an overlap arm. The embodiment of the overlap end in the form of an overlap sleeve in this case offers the advantage that this sleeve has a large area for the embodiment or attachment of the guide region and/or the piston drive element. By contrast, an overlap end embodied in the form of at least one overlap arm has the advantage of requiring less material. The embodiment of the overlap end in the form of at least one overlap arm also has the advantage that it can be embodied so that other elements of the electric handheld power tool—in particular drive elements—can be situated in the vicinity of the end of the hammer tube.

According to an advantageous proposal, the piston is embodied in the form of a hollow piston with a cavity. The embodiment of the piston as a hollow piston saves material and also makes available additional space into which additional components of the electric handheld power tool can be built. This makes it possible to further reduce the overall length of the electric handheld power tool. In connection with the impact mechanism according to the invention, a "hollow piston" is also understood to be a hollow piston whose cavity is formed by the piston and its overlap arms.

According to another advantageous proposal, the cavity of the hollow piston has an access opening that is situated at the end remote from the hammer tube. For example, a part of the piston drive unit or another element of the electric handheld power tool protrudes through the access opening into the cavity of the hollow piston. In connection with the impact mechanism according to the invention, the term "hollow piston" is not limited to a pot piston, which is known in the context of impact mechanisms and simultaneously accommodates the striking element in order to guide the latter.

The invention also relates to an electric handheld power tool, in particular a rotary and/or percussion hammer equipped with the above-mentioned impact mechanism.

BRIEF DESCRIPTION OF THE DRAWINGS

The invention will be explained in greater detail below in conjunction with the drawings.

DESCRIPTION OF THE PREFERRED EMBODIMENTS

Figure 1:
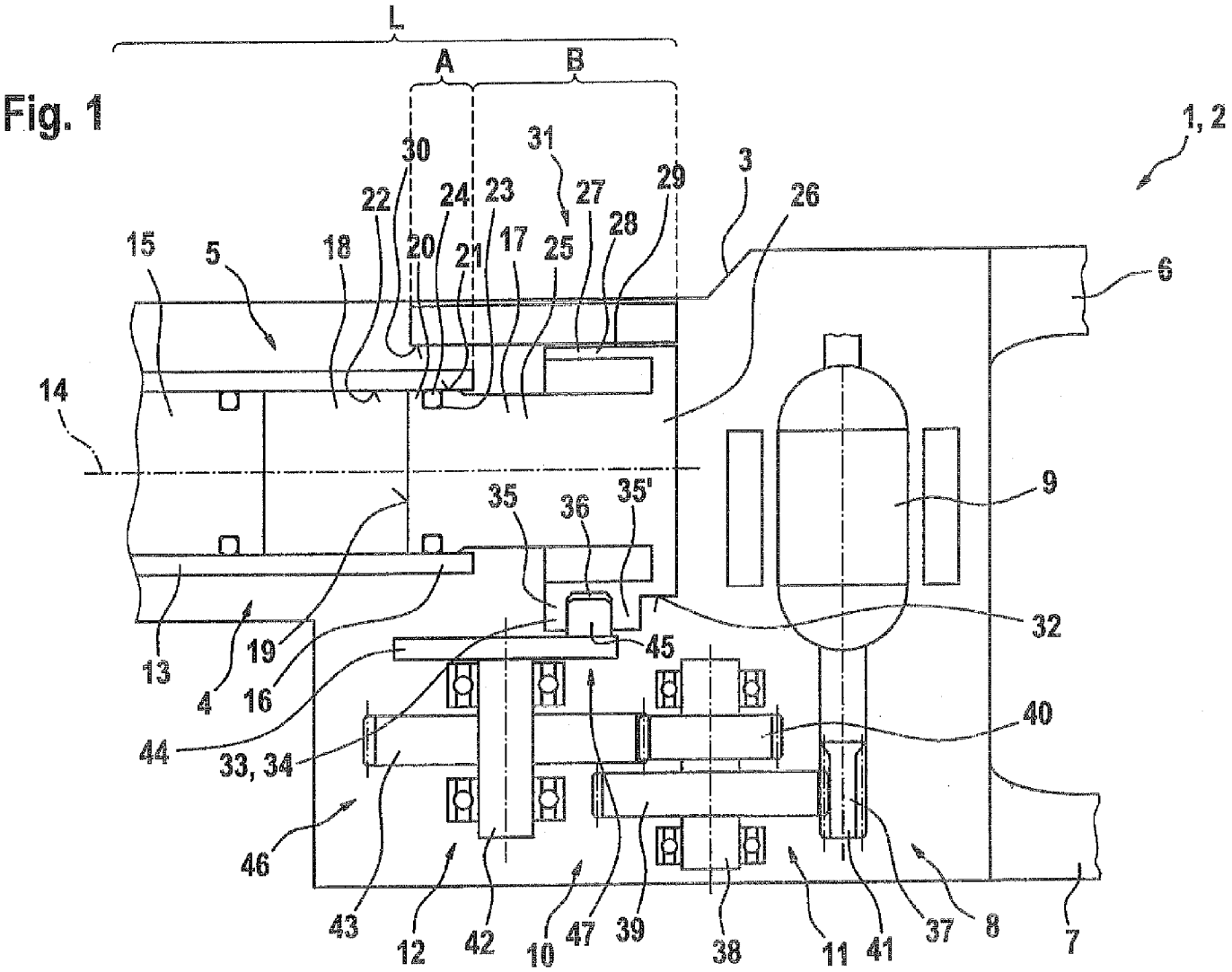
FIG. 1 shows a first exemplary embodiment of the invention.

FIG. 1 is a schematic side view of part of an electric handheld power tool 1 embodied in the form of a percussion hammer 2. The percussion hammer 2 has an impact mechanism 5 situated in a middle section 3 of a housing 4. Between the impact mechanism 5 and a handle 6 at the end 7 of the housing, there is a drive unit 8, which has an electric motor 9, and a two-stage transmission 10 equipped with a first transmission stage 11 and a second transmission stage 12. The impact mechanism 5 is essentially composed of a hammer tube 13 with a longitudinal axis 14, a striking element 15 supported in the hammer tube 13, and a piston 17 situated in the end region 16 of the hammer tube 13. Between the striking element 15 and the piston 17 in the hammer tube 13, there is an air cushion 18 via which the piston 17 drives the striking element 15. Oriented toward the striking element 15, the piston 17 has an end surface 19, which is adjoined by a guide section 20 of the piston 17. The guide section 20 has a circumference surface 21 that faces an inner surface 22 of the hammer tube 13. In its circumference surface 21 in the guide section 20, the piston 17 has an annular groove 23 that contains an 0-ring 24 for producing a seal between the piston 17 and the inner surface 22 of the hammer tube 13. The guide section 20 of the piston 17 is axially adjoined by an inner piston 25 that extends to a piston end 26 of the piston 17 and has a smaller diameter than the piston 17 in the guide section 20. The piston end 26 has an overlap end 27 that partially overlaps the inner piston 25. The overlap end 27 and the piston end 26 combine to form an overlap sleeve 28, which likewise encompasses the end region 16 of the hammer tube 13 when slid inward into a position in which the piston 17 is situated completely inside the hammer tube 13, except for the piston end 26. The circumference surface of the overlap sleeve 28 constitutes a guide region 29 that cooperates with an inner surface 30 of an external piston guide 31. The external piston guide 31 is situated outside the hammer tube 13 and encompasses the end region 16 of the hammer tube 13 in a section A and also encompasses an axial region B adjoining the end region 16 that adjoins the end region 16 of the hammer tube 13. The external piston guide 31 has a C-shaped contour in a section with a cutting surface perpendicular to the longitudinal axis 14, with which it circumferentially encompasses the overlap sleeve 28, with one circumference region left out. In this circumference region, the outside 32 of the overlap end 27 has a sliding block guide 33 arranged perpendicular to the longitudinal axis 14 of the hammer tube 13. The sliding block guide 33 is a piston drive element 34 and is composed of two opposing ribs 35, 35', which are of one piece with the overlap sleeve 28 in the exemplary embodiment shown. A groove 36 is formed between the ribs 35, 35'.

The drive unit 8 includes the electric motor 9 and the two-stage transmission 10 with the first transmission stage 11 and the second transmission stage 12. It is part of the impact mechanism 13. The electric motor 9 has an output shaft 37 that is situated parallel to a rotatably supported shaft 38 of the first transmission stage 11. The first transmission stage 11 is composed of the shaft 38 that is supported by two roller bearings spaced apart from each other and on which two transmission gears 39, 40, each provided with a gearing, are situated spaced apart from each other and fixed for co-rotation with the shaft 38. The transmission gear 40 here has a smaller diameter than the transmission gear 39. The free end 41 of the output shaft 37 is provided with a gearing that meshes with a spur gearing of the transmission gear 39.

The second transmission stage 12 is essentially composed of a rotatably supported shaft 42, which is supported by two roller bearings spaced apart from each other. A transmission gear 43 and an eccentric wheel 44 are mounted on the shaft 42 and fixed for co-rotation with the shaft 42. The transmission gear 43 of the second transmission stage 10 meshes with the transmission gear 40 of the first transmission stage 11. The eccentric wheel 44 has a pin-shaped eccentric protrusion 45 that is situated eccentric to the longitudinal axis of the shaft 42 and engages in the groove 36 of the sliding block guide 33. The part of the drive unit 8 shown is consequently a piston drive unit 46 that converts the rotary motion of the shaft 42 into an oscillating reciprocation of the piston 17 by means of an eccentric mechanism 47.

The impact mechanism according to the invention functions as follows: in order to reduce the overall length L of the impact mechanism 5, which includes the hammer tube 13, the piston 17 supported in a longitudinally movable fashion in the hammer tube 13 by means of its guide section 20, and the external piston guide 31 along which the guide region 29 of the piston 17 is guided in a longitudinally movable fashion, the piston end 26 situated outside the hammer tube 13 is provided with the overlap end 27. The guide region 29 comprises part of the overlap end 27. The arrangement of the guide region 29 at the overlap end 27 makes it possible to shift the position of the external piston guide 31 in the direction toward the hammer tube 13 in comparison to an impact mechanism not according to the invention, which has a piston without an overlap end and has a guide region 29 with a guidance area of the same magnitude. This shifting makes it possible to produce an axial section A ("overlap region") in which the external piston guide 31 encompasses the end region 16 of the hammer tube 13. This reduces the overall length L of the impact mechanism 5 by the length 1 of the section A, which constitutes the reduction in the length by which the external piston guide 31 protrudes axially beyond the end region 16 of the hammer tube 13.

The overall length L can also be further reduced by the fact that the eccentric protrusion 45 of the eccentric mechanism 47 engages in the piston drive element 34 embodied in the form of a sliding block guide 33 in the region of the overlap end 27.

Figure 2:
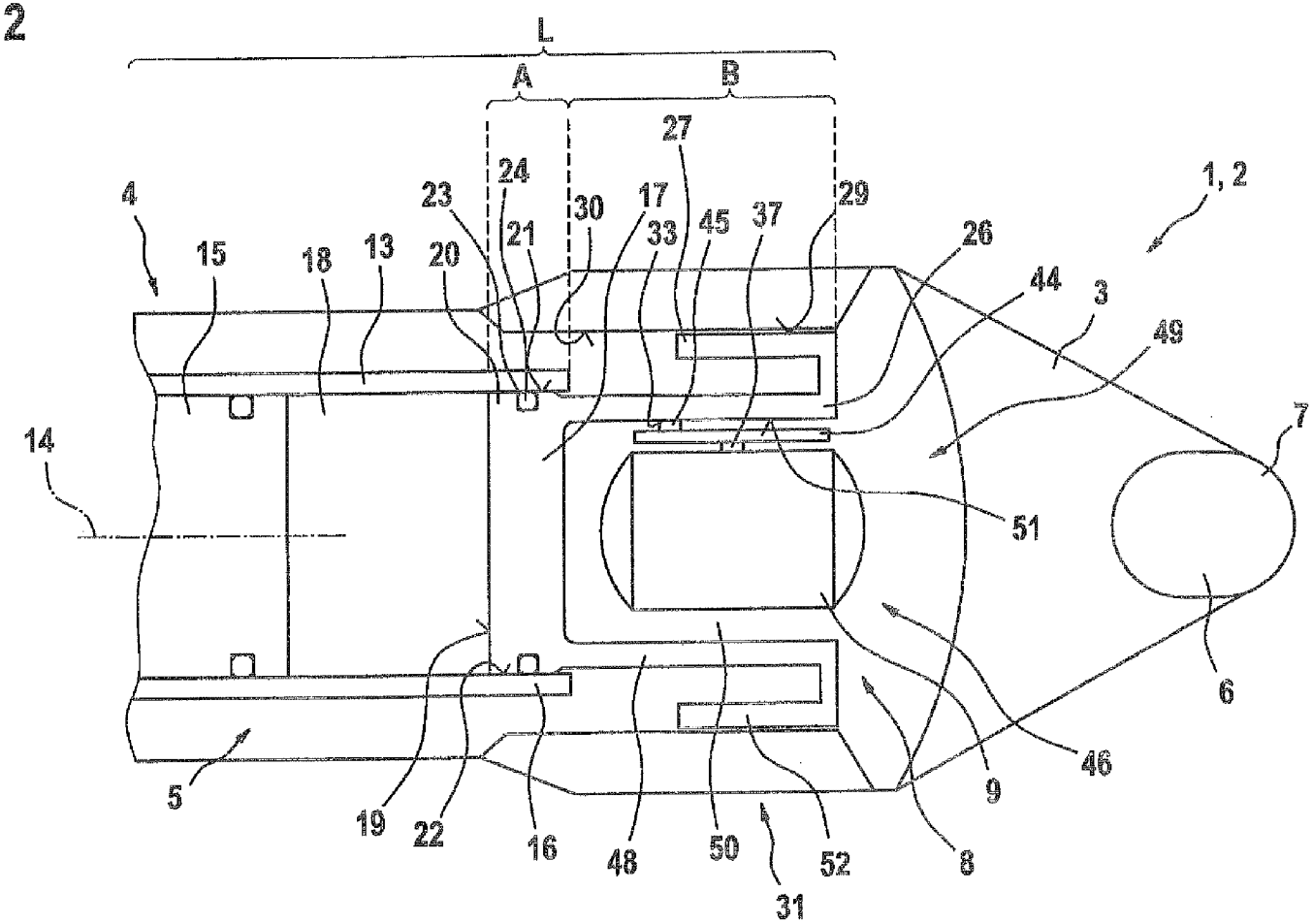
FIG. 2 shows a second exemplary embodiment of the invention.

Since the electric handheld power tool 1 in FIG. 2 essentially corresponds to the one in FIG. 1, only the differences will be discussed below. The piston 17 of the impact mechanism 5 shown in FIG. 2 is embodied in the form of a hollow piston 48 that has an access opening 49 situated at the end remote from the hammer tube 13. The piston drive unit 46 is situated in the resulting cavity 50 of the hollow piston 48. This piston drive unit 46 is composed of the electric motor 9 with its output shaft 37 to which the eccentric wheel 44 is fixed for co-rotation. The eccentric protrusion 45 of the eccentric wheel 44 in this case engages in a sliding block guide 33 situated on the inner surface 51 of an overlap arm 52. The overlap arm 52 also supports an overlap end 27 with a guide region 29 for guiding the piston 17. With this arrangement, the overall length L of the impact mechanism 5 and therefore also the overall length of the electric handheld power tool 1 is reduced even further since the piston drive unit 46 composed of the electric motor 9 and the eccentric wheel 44 with the eccentric protrusion 45 is situated in the cavity 50 of the hollow piston 48.

The foregoing relates to the preferred exemplary embodiments of the invention, it being understood that other variants and embodiments thereof are possible within the spirit and scope of the invention, the latter being defined by the appended claims.

The invention claimed is:

1. An impact mechanism of an electric handheld power tool, in particular a rotary or percussion hammer, comprising:

a hammer tube;

a piston supported in a longitudinally movable fashion in the hammer tube by means of a guide section; and an external piston guide, which is situated outside the hammer tube, and by which a guide region of the piston is guided in a longitudinally movable fashion, wherein one end of the piston is situated completely outside the hammer tube, said one end of said piston having an overlap end attached to it for overlapping an end region of an exterior portion of the hammer tube, and wherein the guide region of the piston is at least partly a component of the overlap end or is fastened to it.

2. The impact mechanism as reciting claim 1, wherein a piston drive element that is part of a piston drive unit is at least partially embodied on the overlap end or is fastened to it.

3. The impact mechanism as reciting claim 2, wherein the piston drive unit has an eccentric mechanism that cooperates with the piston drive element to produce movement of the piston.

4. The impact mechanism as reciting claim 3, wherein the piston drive element is embodied as of a sliding block guide.

5. The impact mechanism as reciting claim 4, wherein the eccentric mechanism has an eccentric protrusion that engages in the sliding block guide.

6. The impact mechanism as reciting claim 3, wherein the eccentric mechanism has an eccentric protrusion that engages in the sliding block guide.

7. The impact mechanism as reciting claim 2, wherein the impact mechanism includes the piston drive unit.

8. The impact mechanism as reciting claim 3, wherein the overlap end with the one end of the piston constitutes an overlap sleeve or at least an overlap arm.

9. The impact mechanism as reciting claim 3, wherein the piston is embodied as a hollow piston with a cavity that contains at least part of the piston drive unit.

10. The impact mechanism as reciting claim 9, wherein the cavity of the hollow piston has an access opening that is situated at an end of the piston remote from the hammer tube.

11. The impact mechanism as reciting claim 2, wherein the piston drive element is embodied as of a sliding block guide.

12. The impact mechanism as reciting claim 11, wherein the impact mechanism includes the piston drive unit.

13. The impact mechanism as reciting claim 2, wherein the impact mechanism includes the piston drive unit.

14. The impact mechanism as reciting claim 2, wherein the overlap end with the one end of the piston constitutes an overlap sleeve or at least an overlap arm.

15. The impact mechanism as reciting claim 2, wherein the piston is embodied as a hollow piston with a cavity that contains at least part of the piston drive unit.

16. The impact mechanism as reciting claim 15, wherein the cavity of the hollow piston has an access opening that is situated at an end of the piston remote from the hammer tube.

17. The impact mechanism as reciting claim 1, wherein the overlap end with the one end of the piston constitutes an overlap sleeve or at least an overlap arm.

18. The impact mechanism as reciting claim 1, wherein the piston is embodied as of a hollow piston with a cavity that contains at least part of the piston drive unit.

19. The impact mechanism as reciting claim 18, wherein the cavity of the hollow piston has an access opening that is situated at an end of the piston remote from the hammer tube.

20. An electric handheld power tool, in particular a rotary or percussion hammer, having an impact mechanism as recited in claim 1.

* * * * *